US005390512A

United States Patent [19]

Mista

[11] Patent Number: 5,390,512

[45] Date of Patent: Feb. 21, 1995

[54] WARP KNITTING MACHINE WITH PIEZOELECTRICALLY CONTROLLED JACQUARD PATTERNING

[75] Inventor: Kresimir Mista, Heusenstamm, Germany

[73] Assignee: Karl Mayer Textilmaschinenfabrik GmbH, Obertshausen, Germany

[21] Appl. No.: 104,369

[22] Filed: Aug. 9, 1993

[30] Foreign Application Priority Data

Aug. 14, 1992 [DE] Germany ..... 4226899

[51] Int. Cl.[6] ..... D04B 27/37; D03C 3/20

[52] U.S. Cl. ..... 66/205; 66/218

[58] Field of Search ..... 66/85 R, 204, 205, 207, 66/218, 219, 220, 221, 125 R

[56] References Cited

U.S. PATENT DOCUMENTS

| | | | |
|---|---|---|---|
| 4,570,462 | 2/1986 | Roth | 66/204 |
| 4,841,750 | 6/1989 | Zorini | 66/204 |
| 5,027,619 | 7/1991 | Saito | 66/218 |
| 5,150,587 | 9/1992 | Bergmann | 66/204 X |

FOREIGN PATENT DOCUMENTS

| | | | |
|---|---|---|---|
| 0210790 | 2/1987 | European Pat. Off. | 66/218 |
| 2316794 | 10/1974 | Germany . | |
| 3344278 | 11/1984 | Germany | 66/204 |
| 1201558 | 8/1989 | Japan | 66/218 |
| 2182951 | 7/1990 | Japan | 66/218 |
| 3234848 | 10/1991 | Japan | 66/218 |

*Primary Examiner*—Clifford D. Crowder
*Assistant Examiner*—John J. Calvert
*Attorney, Agent, or Firm*—Omri M. Behr; Matthew J. McDonald

[57] ABSTRACT

There is provided a warp knitting machine with a jacquard control mechanism. Piezoelectric transducers are provided to each individual guide of a guide bar. These transducers can displace the guides by the application of a control potential. In particular, the piezoelectric transducers are formed as deflecting transducers. These transducers can comprise a plate-like carrier upon which there is provided at least one active layer of piezoelectric material. A holding arrangement of the guide bar can rigidly support one end segment of the plate, whose other end can carry the guide. This gives rise to a very easily constructed jacquard arrangement.

19 Claims, 2 Drawing Sheets

WARP KNITTING MACHINE WITH PIEZOELECTRICALLY CONTROLLED JACQUARD PATTERNING

FIELD OF THE INVENTION

The present invention relates to a warp knitting machine with jacquard controls, and in particular to a machine wherein the guides of at least one guide bar are displaceable by at least one needle space by means of electrical control instructions.

DESCRIPTION OF RELATED ART

A warp knitting machine of this general type is known and disclosed in German Patent DE OS 402 8390. In that device spring-loaded displacing elements are moved vertically by means of a harness cord, whereby the corresponding guide is displaced from a rest position into a working position. The upper end of the harness cord is connected with a setting means, which is carried by a cam plate that reciprocates vertically in each working cycle. The setting means carries a hook which comes into connection with a counterhook on the armature of an electromagnet and then holds the setting means in the raised position when the electromagnet is activated, but remains out of contact with the hook and allows the setting means to sink when the electromagnet is not activated. The electromagnet and the arrangement of the harness cords involves a substantial utilization of space and weight.

DE PS 33 21 733 discloses a jacquard controlled machine working with harness strings. The strings locate the guides between two striker points rigidly attached to the bar. The guides are provided with two protrusions facing in opposite directions. These protrusions act as angularly shaped displacing elements that are alternately engaged by means of a slider connected to the harness cord. This way, the guides are pressed to either one striker or the other whereby, both working positions are clearly defined.

Piezoelectrical deflecting transducers have heretofore been used for special purposes; for example, for the control of a fiber optic relay (Dissertation of Eicher. "Optimization of a piezoelectric deflecting transducer as an example in a fiber optic relay", Berlin, 1989.)

Accordingly, one object of the present invention is to provide a warp knitting machine of the above described type having a substantially simpler jacquard control arrangement.

SUMMARY OF THE INVENTION

In accordance with the illustrative embodiments demonstrating features and advantages of the present invention, there is provided a jacquard control arrangement in a warp knitting machine. The control arrangement includes a control means for providing electrical command signals signifying a jacquard sequence. Also included is at least one guide bar and a plurality of guides supported by the guide bar. The guides are displaceable effectively by at least one needle space. The control arrangement also includes a plurality of piezoelectric transducers coupled to the control means and separately mounted at corresponding ones of the guides for displacing the guides in response to the electrical command signals.

The foregoing apparatus provides an advantageous knitting machine that can utilize piezoelectric transducers attached to the guide bar to displace the guides by the application of a controlling potential. Such piezoelectric transducers are comparatively small structural elements which (including the appropriate control leads) can be provided to jacquard guide bars with very small space consumption. This compactness avoids the need for other displacing elements which require harness cords, electromagnetic devices or other jacquard arrangements atop the warp knitting machine. Moreover, the construction and maintenance costs are substantially reduced. In addition, the piezoelectric transducers work with very low failure rates, therefore the general operating costs are lower.

The masses to be moved are merely a fraction of the masses which must be moved in the generally known cases. Thus, substantially smaller forces are required for the displacement. In order to obtain these forces one may utilize piezoelectric transducers utilizing low voltage, that is to say, a potential of less than 100 volts. The transducers can therefore be provided exceedingly close together (which is very necessary because of the small distance between the guides) without insulation problems. Furthermore, the switching time is very short so that such a jacquard control arrangement can be installed even with very fast warp knitting machines.

A further advantage is that the piezoelectric devices can be provided as deflecting transducers. Such deflecting transducers are readily available in the trade and lead to larger setting movements, as with piezoelectric transducers of other types.

A particularly compact construction is found when the deflecting transducers are installed between the guides and the guide bar.

It is advantageous to provide a deflecting transducer to each guide: the transducer having one of its ends attached to the guide bar and its other end rigidly attached to the guide. In this way the free end of the guide moves along a path which is a multiple of the deviation of the bending transducer. Similarly, it is possible to work with small deflecting transducers and nevertheless achieve the appropriate adjustment path for a needle space.

In another embodiment each guide is provided with at least two parallel, deflecting transducers next to each other. Both transducers have one end connected to the guide bar and the opposite ends connected with the guide. In this way there is achieved something like a parallelogram guiding of the guides. Thus the guides remain parallel to the needles, which reduces the danger of needle collisions.

In the simplest case, the deflecting transducers each comprise a plate-like carrier and at least one active layer of piezoelectric material thereon. One end area of the carrier is tightly embedded to a holding arrangement of the guide bar and the other end area carries the guide. By choice of length and breadth of the active layer, it is possible to achieve the desired deviation and force. In this way, the expansion in the direction of the needle bed is very small. The bending transducer can easily fit into a needle space less than 2 mm, which is necessary with a needle arrangement of 28 needles per inch.

In a particularly simple embodiment the carrier and the needle are created as a unit.

There is an alternative mode wherein the guides lie flat on the outer end area of the carrier and are connected thereto by adhesive, soldering, or the like. In this way the material of the carrier can be independent of that of the guide and made appropriate to the function of the deflecting transducer.

It is a further advantageous to provide the carrier with material breaks, located between the active layer and the guide, for forming a bending hinge. This bending hinge prevents the buildup of internal tensions during the parallelogram guiding, which would inhibit the desired deviation.

Preferably, the breadth of the carrier and the active layer are several times greater than the width of the guide. This permits the desired force to be produced during the deviation.

Also, the guides are preferably located between two neighboring striker plates, which are contacted by the guides when reaching their working positions. Thus the two working positions can be defined.

Moreover, the guides preferably lie next to one striker plate due to their normal bias during the inactive state of the deflecting transducer. When the deflecting transducer is activated, the deflecting force brings the guide to the opposite striker plate. If there is excess force during the strike, the guides are held in their working position.

Accordingly, at least one of the strikers plates preferably has a permanent magnet which attracts the guide magnetically. Furthermore, the permanent magnet prevents oscillations or bouncing, which often occur at the moment of strike.

As to electrical connection, the deflecting transducers each comprise a plate-like carrier and thereon at least one active layer of piezoelectrical material. The carrier should be electrically conductive and grounded through its connection with the guide bar. The side of the active layer distal to the carrier side, is provided with an electrode layer, to which a control lead can be attached. It is thus sufficient to provide merely one control line per deflecting transducer in order to properly control it.

Preferably, the control leads from the controller run above the holding arrangement for the carrier for the deflecting transducer. Above the holding arrangement there is sufficient room for the leads, which can be routed as a cable bundle on either or both of the jacquard guide bars.

It is also desirable to have the holding arrangement extend over only part of the width of the carriers. Then the control leads can run along the free areas of the carrier ends. In this way, portions of the holding arrangement can act as a separating means, to permit the free entry of the control leads to the appropriate connection.

It is particularly advantageous if the piezoelectric transducers are operable at a potential of between 25 and 30 volts. Such a potential requires either no or very little insulation. It is also possible to operate with a simple DC to DC converter at the voltages produced by the usual TTL switches, or computer arrangements.

Thus, in the preferred embodiment the jacquard arrangement can comprise a pattern storage means and a computer which for each work cycle of the warp knitting machine, provide appropriate control signals to each piezoelectric controller. The DC to DC converters are provided to converts the original control signals into an appropriate control potential. In this manner one readily obtains a computer control arrangement for a jacquard control.

BRIEF DESCRIPTION OF THE DRAWINGS

The invention may be more readily understood by means of the accompanying drawings which describes the preferred embodiments.

DETAILED DESCRIPTION OF THE PREFERRED EMBODIMENTS

Figure 1:
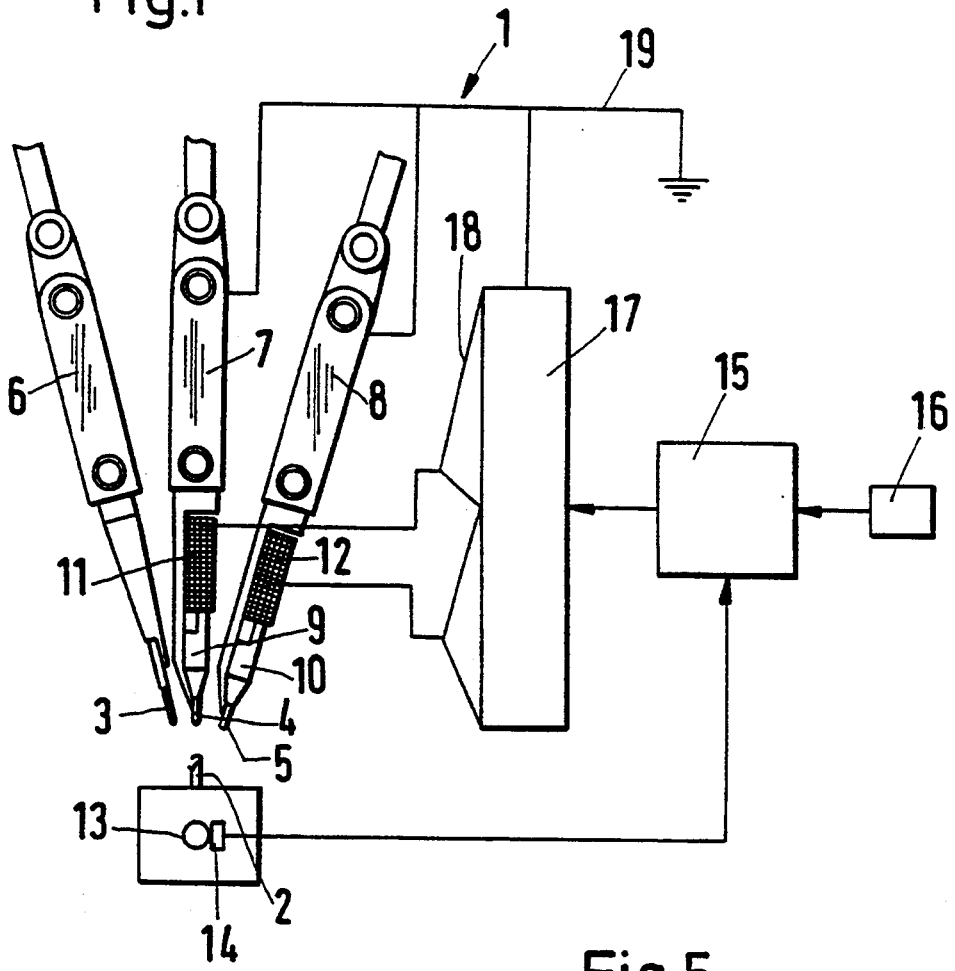
FIG. 1 is a schematic representation of a warp knitting machine according to the principles of the present invention.

FIG. 1 is a schematic view of a warp knitting machine 1, which comprises a row of needles 2 and three rows of guides 3, 4 and 5. The guides 3, 4, and 5 are attached to guides bars 6, 7 and 8, respectively. The guide bars 6, 7 and 8 shog back and forth to provide overlaps and underlaps, in the conventional manner. Specifically, bars 6, 7 and 8 are reciprocated axially (that is, perpendicular to the plane of the drawing) by patterning arrangements, such as pattern wheels.

The guides 3 have the same spacing as the needles 2. The guide to guide spacing for guides 4 and for guides 5 is twice the needle to needle spacing for needles 2. Furthermore, guides 4 and 5 are jacquard controllable and displaceable by one needle space.

The jacquard control for each of the guides 4 and 5 has a piezoelectric transducer 9 and 10, which is controllable via electrical leads 11 and 12. For this purpose the main shaft 13 of the warp knitting machine is provided with a rotational angle measuring means 14 (for example, a shaft encoder), which provides its rotational angle signals to computer 15. A pattern storage means (for example, computer memory 16) is connected thereto. Based upon the stored pattern values in memory 16, the computer 15, for each work cycle of the knitting machine provides each individual piezoelectric transducer 9 and 10 with the appropriate control signal.

Before application of the control signal to the transducers, these computer signals are transmitted at a potential of about 5 volts to a plurality of DC to DC converters 17, whose outputs 18 are bundled into control leads 11 and 12. When activated by the computer 15 the appropriate output provides a potential in the low voltage area, suitably in the order of 25 to 30 volts. This potential is referenced between the control lead and a ground connection 19. This ground connection is common to the DC/DC converter 17 and the guide bars 7 and 8. The deflecting transducers are so provided that at this potential they create the desired deviation of the guide 5.

Figure 2:
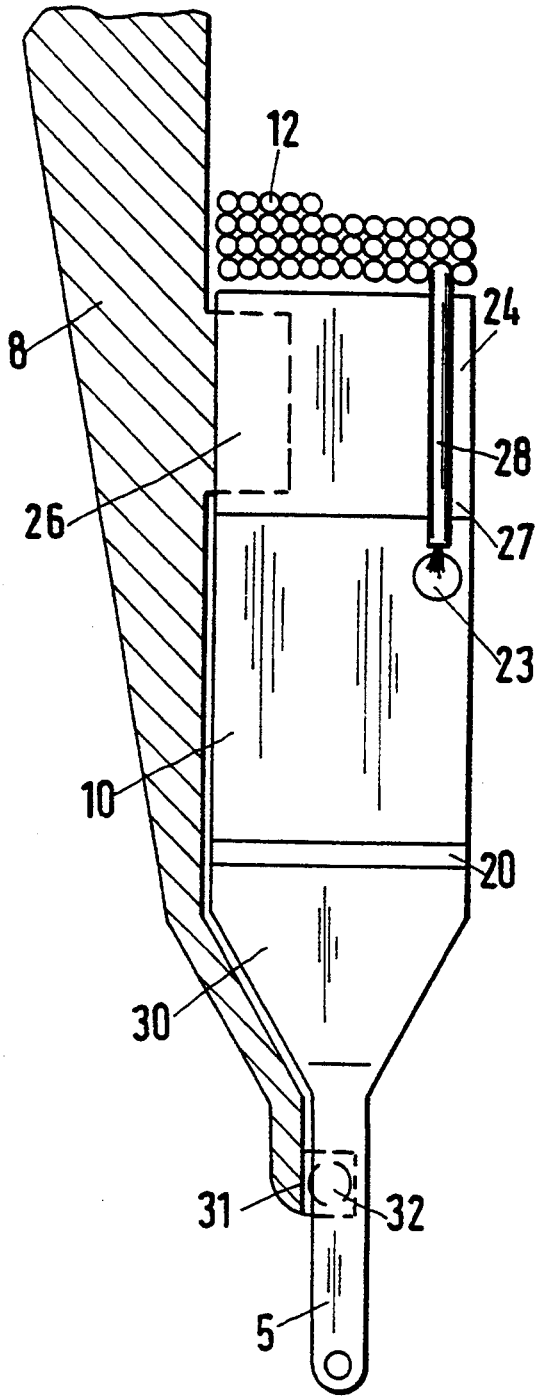
FIG. 2 is a detailed, elevational, cross-sectional view of the lower segment of the jacquard guide bar.
Figure 3:
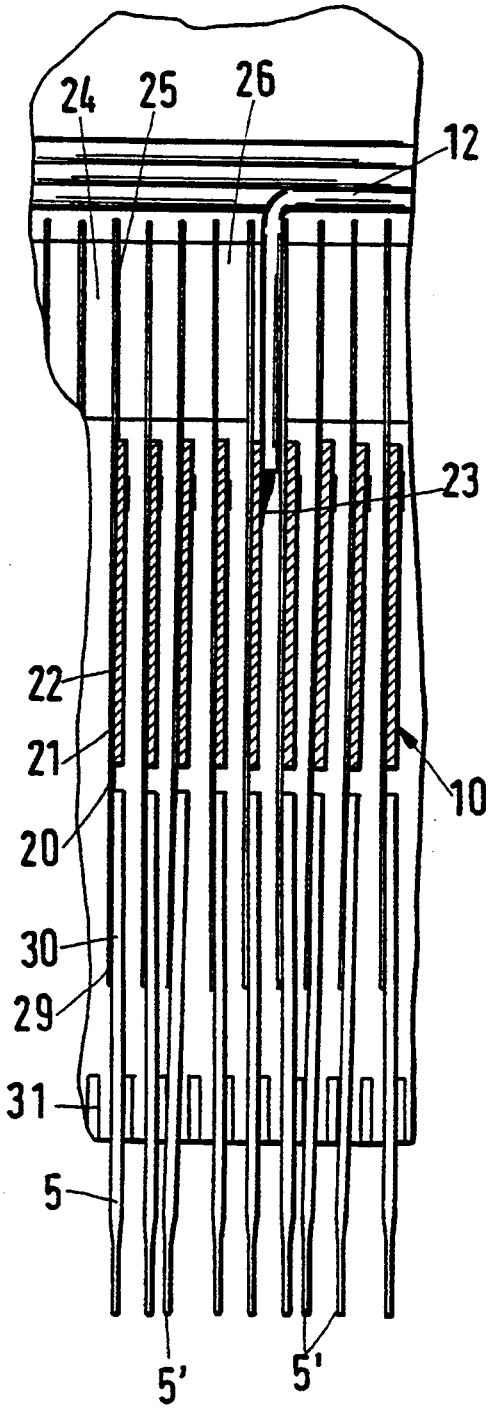
FIG. 3 is a view of FIG. 2 from the right.

FIGS. 2 and 3 show a deflecting transducer 10 in the form of a piezoelectric transducer provided individually to the guide bar 8. Each deflecting transducer comprises a carrier 20 in the form of a rectangular plate, which is covered on one side, with a layer 21 of piezoelectrically active material. The outer side of this active layer is provided with an electrode 22 to which is attached a connection means 23 for connecting the control lead 12.

The upper end 24 of carrier 20 is provided into slots 25 in a ledge of guide bar 8, acting as the holding means 26, which is electrically conductive and therefore, can provide a ground for carrier 20. The ends 24 can be affixed in slots 25 by adhesive or by other known means, for example, by means of a sealing wire. The holding arrangement 26 has a depth less than the width of carrier end 24. Thus, free space 27 provides a longitudinal path through which the end segment 28 of the control lead 12 can be fed to the connection 23. On the lower end area 29 of carrier 20, a flat segment 30 adheres to guide 5 with adhesive, solder or otherwise.

Each guide 5 is located between two stops 31 (also referred to as a striker plate), which in each case define the working positions of their associated guide 5. Furthermore, each stop 31 is provided with a permanent magnet 32 which reduces the swinging or bouncing of the guides when landing on a stop.

When a control potential is provided to the deflecting transducer 10, the piezoelectric material will deform. This is only possible on the outer side since, carrier 20 does not permit an expansion or contraction. In accordance with the direction of the control potential provided, the free end of the deflecting transducer is displaced in one or the other direction. As is shown in FIG. 3, such displacement is illustrated for the needles identified as 5'.

Figure 4:
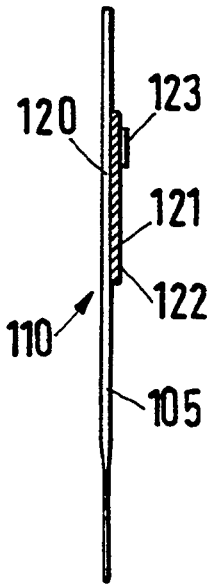
FIG. 4 is a vertical cross-section through an alternate embodiment of the guide.

FIG. 4 shows another embodiment of the bending controller 110 in which the guide 105 and the carrier 120 are of unitary construction. A piezoelectric material is provided as a layer 121 on an active segment. It is further provided with an electrode 122 and an appropriate contact 123.

Figure 5:
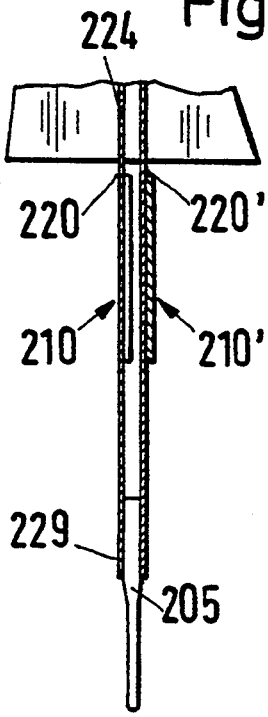
FIG. 5 is a vertical cross-sectional view of another embodiment of the guide.
Figure 6:
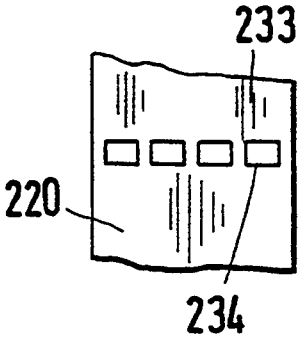
FIG. 6 is a view from the left of FIG. 5.

The embodiment illustrated in FIGS. 5 and 6 has two deflecting transducers 210 and 210', whose carriers 220 and 220' are parallel. They are attached to opposite sides of guide 205 and when activated deviate in the same direction. Thus guide 205 is displaced parallel to itself.

Located between the guide 5 and the deflecting transducers 210 and 210' is a bending hinge 233, which is formed by apertures 234 in carrier 220. This bending hinge serves to reduce the buildup of internal tensions during the deviation.

As material for the active layer one mainly considers piezo-ceramic, that is to say, synthetically produced inorganic, polycrystalline and non-metallic materials. In particular, lead, zirconates, titanates. These obtain their piezoelectric property during polarization with high field strength above the curing temperatures. The active layer can be produced in large surfaces appropriately cut up and then bonded to the previously cut carriers.

If a single active layer and a passive carrier are insufficient for a deflecting transducer, one may utilize a multi-layered substrate with several active piezoelectric layers, for example, a passive layer between two active layers, or several active layers in which at least one operates in the opposite direction as the other active layers upon application of potential.

I claim:

1. In a warp knitting machine, a jacquard control arrangement comprising:

a control means for providing electrical command signals signifying a jacquard sequence;

at least one guide bar;

a plurality of guides supported by said guide bar and displaceable effectively by at least one needle space; and a plurality of piezoelectric transducers coupled to said control means and separately mounted at corresponding ones of said guides for displacing said guides in response to said electrical command signals, said piezoelectric transducers each comprising a deflecting transducer having one end attached to the guide bar and another end rigidly attached to a corresponding one of said guides, said deflecting transducers being mounted between the guides and the guide bar.

2. In a warp knitting machine in accordance with claim 1 wherein each of said piezoelectric transducers comprises:

a spaced pair of parallel deflecting transducers, both connected between the guide bar and a corresponding one of the guides.

3. In a warp knitting machine in accordance with claim 1 wherein the deflecting transducers each comprise:

a plate-like carrier having one end area rigidly connected to the guide bar and another end area supporting a corresponding one of the guides; and at least one active layer of piezoelectric material mounted on said carrier.

4. In a warp knitting machine in accordance with claim 1 wherein the guides each comprise:

a plate-like carrier having one end area rigidly connected to the guide bar, each of said piezoelectric transducers comprising at least one active layer of piezoelectric material mounted on the plate-like carrier of a corresponding one of said guides.

5. In a warp knitting machine in accordance with claim 3 wherein the guide partially overlaps the carrier and is bonded thereto.

6. In a warp knitting machine in accordance with claim 3 wherein the carrier has at least one aperture therein between the active layer and the guide for the formation of a bending hinge.

7. In a warp knitting machine in accordance with claim 4 wherein the carrier has at least one aperture therein between the active layer and the guide for the formation of a bending hinge.

8. In a warp knitting machine in accordance with claim 3 wherein both the carrier and the active layer are several times wider than the guide.

9. In a warp knitting machine in accordance with claim 4 wherein both the carrier and the active layer are several times wider than the guide.

10. In a warp knitting machine in accordance with claim 1 comprising:

a pair of neighboring striker plates located on opposite sides of the guides to limit and define two working positions of said guide.

11. In a warp knitting machine in accordance with claim 3 comprising:

a pair of neighboring striker plates located on opposite sides of the guides to limit and define two working positions of said guide.

12. In a warp knitting machine in accordance with claim 4 comprising:

a pair of neighboring striker plates located on opposite sides of the guides to limit and define two working positions of said guide.

13. In a warp knitting machine in accordance with claim 8 wherein when the deflecting transducer is biased rests when inactive on one of the striker plates, the other one of the striker plates limiting deflection caused by said deflecting transducer when active.

14. In a warp knitting machine in accordance with claim 8 wherein at least one of the striker plates including:

a permanent magnet for attracting a corresponding one of the guides magnetically.

15. In a warp knitting machine in accordance with claim 1 wherein the deflecting transducers each comprise:

a plate-like carrier;

at least one active layer of piezoelectric material coated on said carrier, the carrier being electrically conductive and being held through the guide bar to a reference potential;

an electrode layer mounted on a side of said active layer distal from the carrier; and a control lead connected to said electrode layer.

16. In a warp knitting machine in accordance with claim 15 wherein said guide bar has a holding means for holding the guides and the deflecting transducers, said control lead running along said guide bar on a side of the holding means distal from the guide.

17. In a warp knitting machine in accordance with claim 16 wherein the holding means extends across only a portion of the carrier, leaving unobstructed a longitudinal path over said carrier containing a length of said lead.

18. In a warp knitting machine in accordance with claim 1 wherein the piezoelectric transducers are operable by a potential of about 25 to 30 volts.

19. In a warp knitting machine in accordance with claim 1 wherein the jacquard control arrangement comprises:

a pattern storage means;

a computer for providing said command signals for each work cycle of the warp knitting machine to each piezoelectric transducer; and a voltage converter coupled to said computer for changing the magnitude of direct current potential from said computer to said piezoelectric transducers.

* * * * *